US008646620B2

(12) United States Patent
Klump et al.

(10) Patent No.: US 8,646,620 B2
(45) Date of Patent: Feb. 11, 2014

(54) DISHWASHER RACK ASSEMBLY WITH ADJUSTABLE TINES

(75) Inventors: James Murray Klump, Crestwood, KY (US); Stephen Froelicher, Shepherdsville, KY (US); Rebecca Lynne Hannon, South Lyon, MI (US)

(73) Assignee: General Electric Company, Schenectady, NY (US)

( * ) Notice: Subject to any disclaimer, the term of this patent is extended or adjusted under 35 U.S.C. 154(b) by 286 days.

(21) Appl. No.: 13/112,133

(22) Filed: May 20, 2011

(65) Prior Publication Data

US 2012/0292270 A1 Nov. 22, 2012

(51) Int. Cl.
*A47G 19/08* (2006.01)

(52) U.S. Cl.
USPC ..... 211/41.8

(58) Field of Classification Search
USPC ..... 211/41.8, 41.9, 41.4, 41.3, 41.1, 41.2, 211/41.5
See application file for complete search history.

(56) References Cited

U.S. PATENT DOCUMENTS

| | | | | | |
|---|---|---|---|---|---|
| 1,562,614 | A | * | 11/1925 | Blakeslee | 211/41.8 |
| 3,126,098 | A | | 3/1964 | Geiger et al. | |
| 3,269,548 | A | | 8/1966 | Geiger et al. | |
| 3,402,975 | A | | 9/1968 | Smith | |
| 3,433,363 | A | * | 3/1969 | Clearman et al. | 211/41.8 |
| 3,451,556 | A | | 6/1969 | Macoicz | |
| 3,752,322 | A | * | 8/1973 | Fiocca et al. | 211/41.8 |
| 4,046,261 | A | | 9/1977 | Yake | |
| 4,592,471 | A | * | 6/1986 | Bross | 211/41.2 |
| 4,606,464 | A | | 8/1986 | Jordan et al. | |
| 4,917,248 | A | * | 4/1990 | Friskney | 211/41.8 |
| 5,332,105 | A | * | 7/1994 | Stanfield | 211/41.4 |
| 5,351,837 | A | | 10/1994 | Smith | |
| 6,571,965 | B1 | * | 6/2003 | Beck et al. | 211/41.8 |
| 6,848,585 | B2 | | 2/2005 | VanLandingham | |
| 7,682,465 | B2 | * | 3/2010 | Anderson et al. | 134/56 D |
| 7,793,790 | B2 | * | 9/2010 | Lee | 211/41.9 |
| 7,931,155 | B2 | * | 4/2011 | Bastuji | 211/41.9 |
| 8,104,628 | B2 | * | 1/2012 | Kim | 211/41.8 |
| 8,408,403 | B2 | * | 4/2013 | Hedstrom et al. | 211/41.8 |
| 2001/0047968 | A1 | * | 12/2001 | Wright | 211/41.3 |
| 2003/0089672 | A1 | * | 5/2003 | VanLandingham | 211/41.8 |
| 2006/0108298 | A1 | * | 5/2006 | Kim | 211/41.8 |
| 2006/0254994 | A1 | | 11/2006 | Lim | |
| 2009/0120883 | A1 | * | 5/2009 | Jadhav et al. | 211/41.9 |
| 2012/0292269 | A1 | * | 11/2012 | Klump et al. | 211/41.8 |
| 2012/0292270 | A1 | * | 11/2012 | Klump et al. | 211/41.8 |

FOREIGN PATENT DOCUMENTS

| | | |
|---|---|---|
| KR | 20080012597 | 2/2008 |

* cited by examiner

*Primary Examiner* — Jose V Chen
(74) *Attorney, Agent, or Firm* — Dority & Manning, P.A.

(57) ABSTRACT

A dishwasher rack assembly includes a bottom wall formed of a first set of spaced apart rods crossed by a second set of spaced apart rods to define an open lattice structure. At least one channel member is attached to respective one the rods. A plurality of tines are received within the channel member and are variably positional along the channel member so as to adjust spacing between the tines without adjusting the channel member relative to the rod.

12 Claims, 6 Drawing Sheets

FIG. —1—

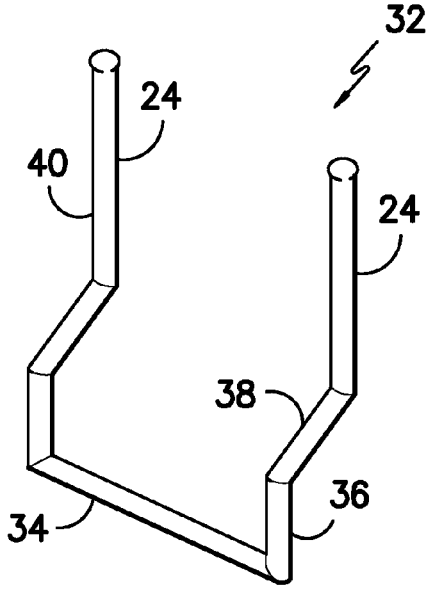
FIG. —3—
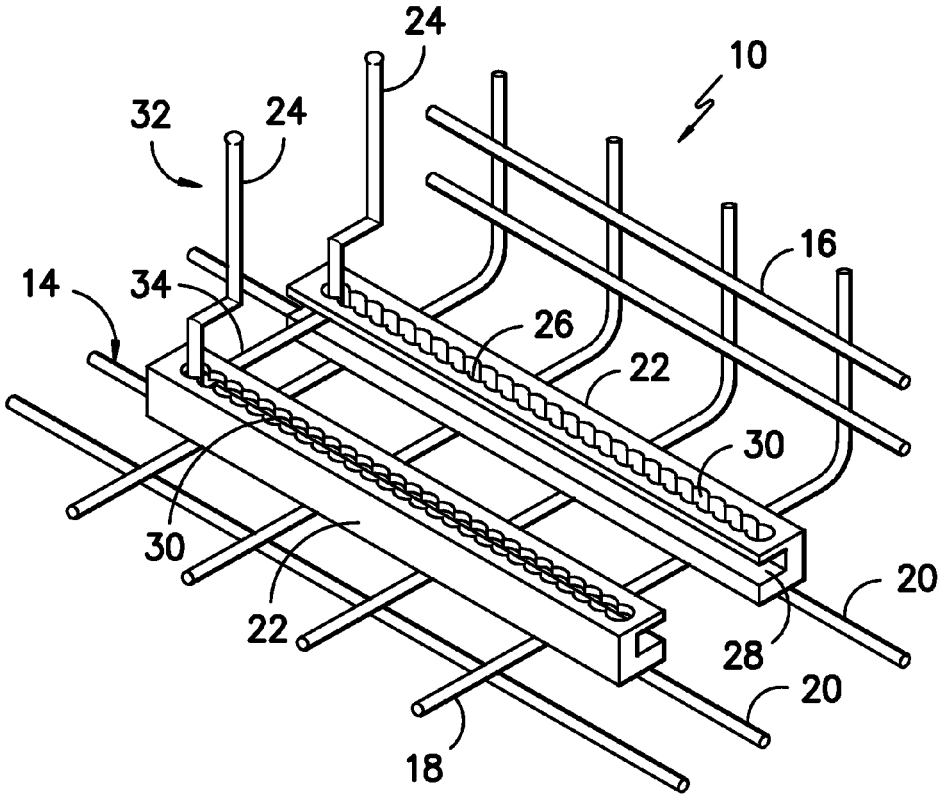
FIG. —4—

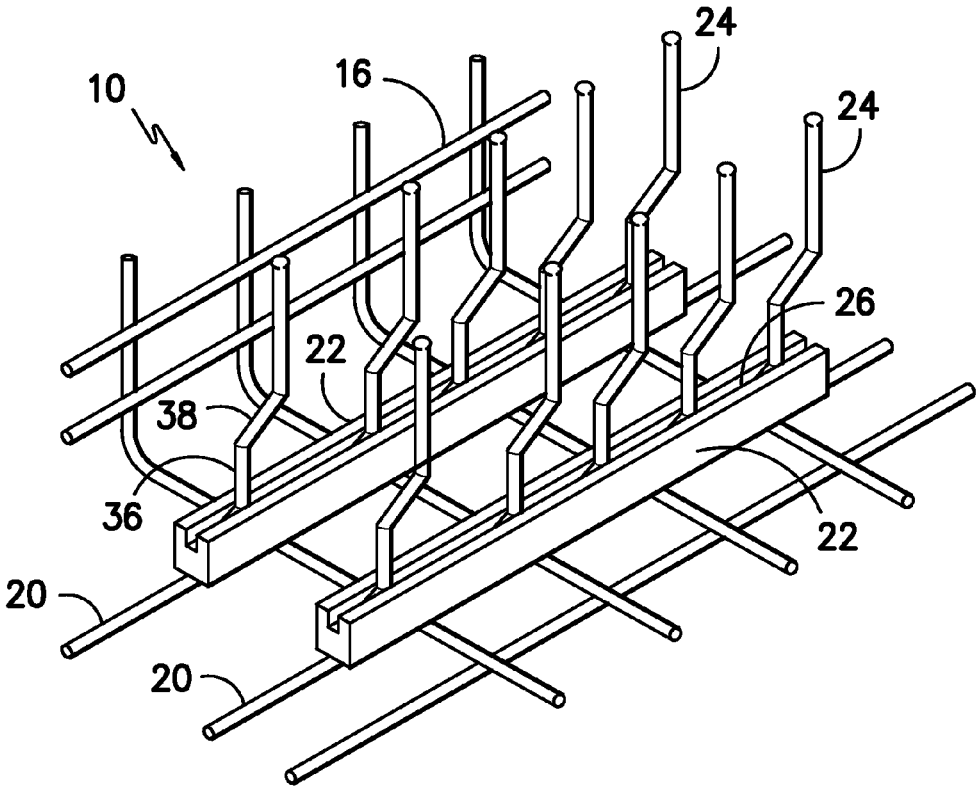
FIG. –5–
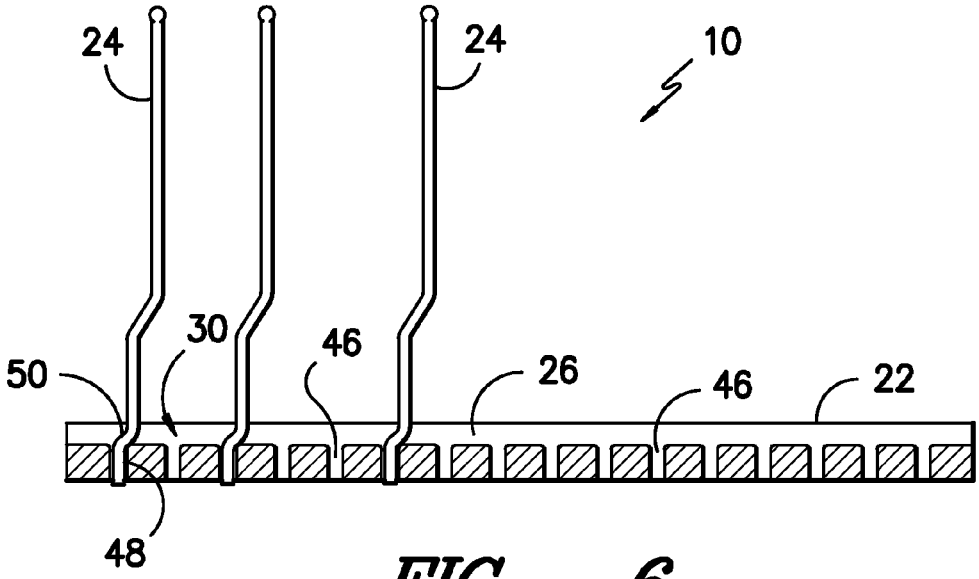
FIG. –6–

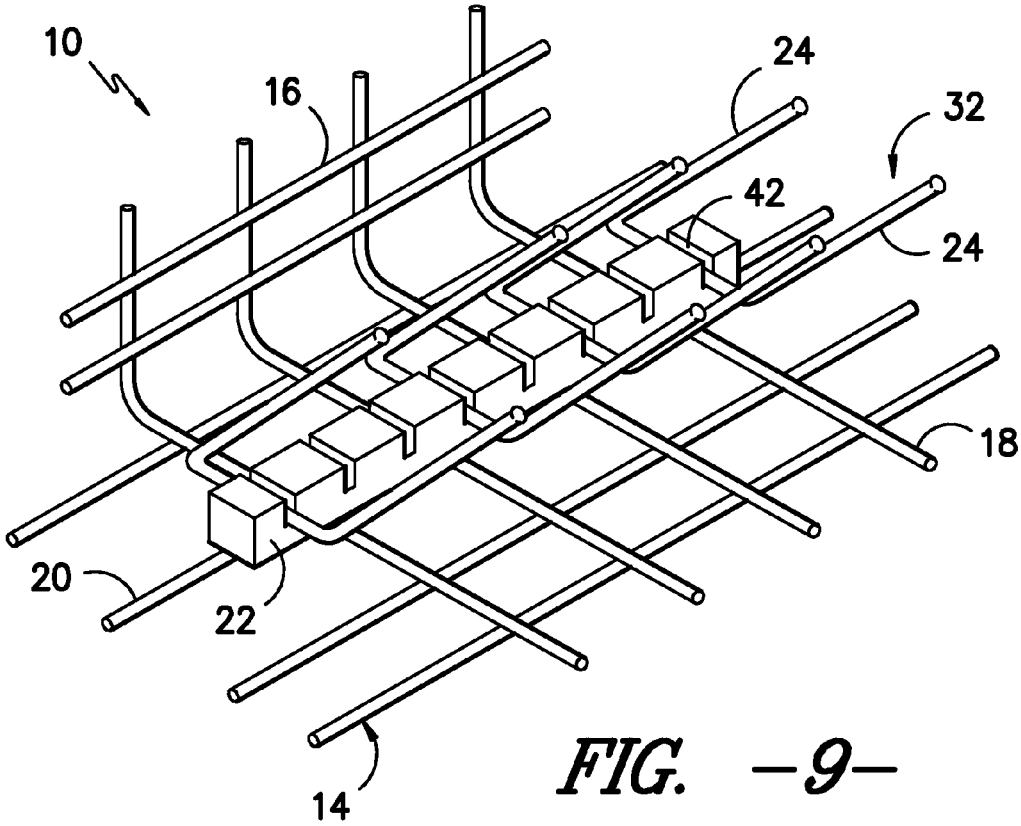
FIG. —9—
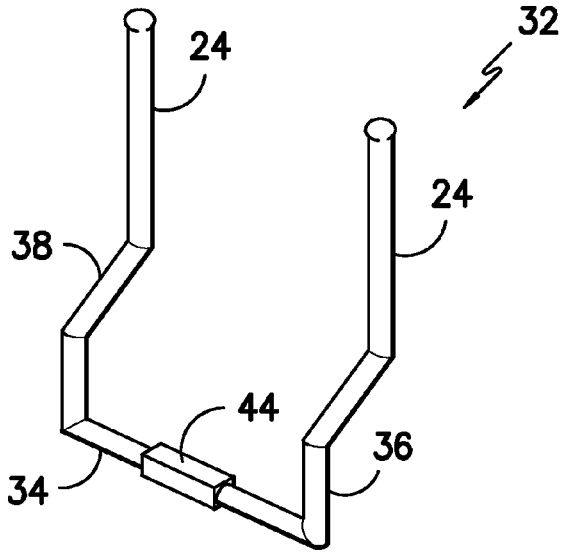
FIG. —10—

DISHWASHER RACK ASSEMBLY WITH ADJUSTABLE TINES

FIELD OF THE INVENTION

The present invention relates generally to rack assemblies for use in domestic dishwashers, and more particularly to a rack assembly with adjustable tines.

BACKGROUND OF THE INVENTION

Conventional dishwashers normally include two racks configured to support items to be washed, such as dishes, glasses, bowls, cooking utensils, and the like. Typically, an upper rack is disposed close to the top of the washing chamber and is used to hold glasses, cups, bowls, and other relatively smaller items. The lower rack is positioned near the bottom of the chamber at a considerable distance below the upper rack to provide vertical clearance to place larger items, such as dishes and platters, on edge and to place food preparation bowls and pots up-side-down on the lower rack for washing. Each rack normally is supplied with an array of spaced apart, generally vertical tines or fingers which support and separate the individual items. The optimum spacing between adjacent tines for supporting thin items like dishes is much less than for supporting thick items like mixing bowls and pans. Thus, any fixed array of tines is less than optimum for all possible combinations of items to be washed.

There have been numerous suggestions for arrangements to provide adjustable tines in a rack assembly for user flexibility. Reference is made, for example, to U.S. Pat. Nos. 3,126,098; 3,269,548; 3,402,975; 3,752,322; 4,046,261; 4,606,464; and 5,351,837.

U.S. Pat. No. 7,682,465 describes a dishwasher rack having an entire tine row assembly that is movable along the rack support elements. One end of the row assembly is slidable within a rail member, and the other end of the row assembly is attached to a slider element that, in turn, attaches to one of the support elements. The pitch (i.e., spacing) of the individual tines is fixed relative to the row assembly, and the tines cannot be adjusted to accommodate articles of different sizes.

The industry is continuously seeking improvements in rack assemblies that provide consumers with ease of adjustment of tines. The present invention relates to such improvements.

BRIEF DESCRIPTION OF THE INVENTION

Aspects and advantages of the invention will be set forth in part in the following description, or may be obvious from the description, or may be learned through practice of the invention.

In accordance with aspects of the invention, a dishwasher rack assembly is provided having a bottom wall formed of a first set of spaced apart rods crossed by a second set of spaced apart rods to define an open lattice structure. The rods may be, for example, lateral rods crossed with longitudinal rods. At least one elongated channel member is attached to one of the rods by any suitable mechanism, such as a clip. A plurality of tines are received within the channel member. The tines are variably positional along the channel member so as to adjust spacing ("pitch") between the tines without adjusting the channel member relative to the rod. In a particular embodiment, the tines are infinitely positionable along the channel member, for example along a groove in the channel member, with the groove defining a friction fit with the tines that holds the tines in an upright orientation within the channel member.

In a different embodiment, the channel member defines vertically oriented discrete tine locations along the length thereof, with the tine locations comprising an engagement profile that holds the tines in an upright orientation within the channel member.

In a particular embodiment of a dishwasher rack assembly, a pair of the channel members is spaced from each other on different ones of the rods, for example on adjacent longitudinal rods or adjacent lateral rods. A plurality of U-shaped tine members having a bridge between opposite tines are provided, with the bridge extending between the channel members and the tines received within the channel members. In this embodiment, the tines are variably positionable as a pair along the channel members by movement of the U-shaped tine member relative to the channel members. The channel members may be variously configured in this embodiment. For example, the channel members may comprise a top groove through which the tines project and a side groove that accommodates sliding movement of the bridge member along the channel members. The top groove may define a plurality of discrete tine locations along the length thereof, with the tine locations comprising an engagement profile that holds the tines in an upright orientation within the channel members. In an alternate embodiment, the tines are infinitely positionable to any location along the top groove, with the top groove defining a friction fit with the tines that holds the tines in an upright orientation within the channel members.

In certain embodiments, the channel member or members define vertically oriented discrete tine locations along the length thereof, with the tine locations comprising an engagement profile that holds the tines in an upright orientation within the channel members, whereby the tines are adjustable along the channel members upon flexing of the tines inwardly to disengage the tines from the tine locations.

In a further unique embodiment, a plurality of U-shaped tine members with a bridge between opposite tines is received within a single channel member such that the tines extend on opposite sides of the channel member. The channel member may include a plurality of discrete horizontally oriented bridge locations defined along the length thereof, with the U-shaped tine members movable into and out of the bridge locations. The bridge locations may be defined in a top surface of the channel member and comprise a cross-sectional shape that engages a complimentary-shaped section of the bridge that holds the tines in an upright orientation within the channel member. In a particular embodiment, the bridge is rotatable within the bridge locations such that the tines are rotatable to a down position wherein the tines lie across the rod members.

In still a different embodiment, a pair of the channel members may be spaced from each other on different ones of the rods, with the tines individually positionable in respective ones of the channel members such that the tines in one channel member are variably positionable independent of the tines in the other channel member. The channel members may have a plurality of discrete tine locations along the length thereof, with the tines insertable into the tine locations. The tines may have a stepped-profile insertion end that is insertable into vertically oriented receipt holes at the respective tine locations to hold the tines in an upright orientation within the channel members.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 is a perspective view of an embodiment of a U-shaped tine member;

FIG. 4 is a perspective view of an embodiment of channel members with the tine member of FIG. 3;

FIG. 5 is a perspective view of an alternate embodiment of channel member with individual tine members;

FIG. 6 is a cross-sectional view of the embodiment of FIG. 5;

FIG. 9 is a perspective view of the embodiment of FIG. 8 with the tine members rotated to a down position; and FIG. 10 is a perspective view of an embodiment of a tine member that may be used with the embodiment of FIG. 9.

DETAILED DESCRIPTION OF THE INVENTION

Figure 1:
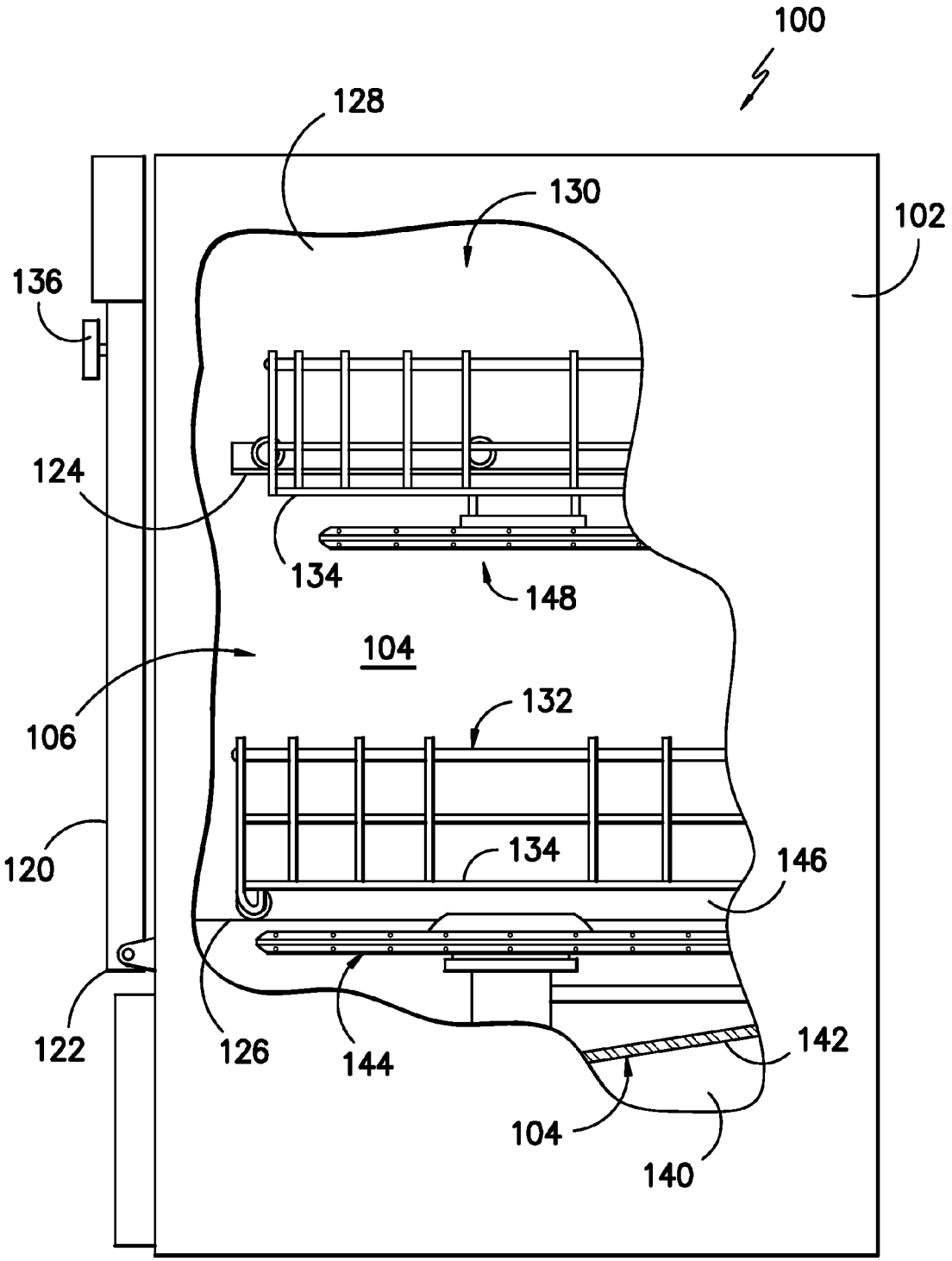
FIG. 1 is a side, partially broken-way view of an exemplary dishwasher.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a view of an exemplary domestic dishwasher 100 shown in partial cut-away and is representative of a type of a dishwasher that may incorporate a rack assembly in accordance with aspects of the invention. It should be appreciated, however, that the present rack assemblies are not limited to use in any particular type of dishwasher, and that the dishwasher 100 in FIG. 1 is presented for illustrative purposes only.

Briefly, the dishwasher 100 includes a cabinet 102 having a tub 104 therein that defines a wash chamber 106. The tub 104 includes a front opening (not shown in FIG. 1) and a door 120 hinged at its bottom 122 for movement between a normally closed vertical position wherein the wash chamber 106 is sealed shut for washing operation, and a horizontal open position for loading and unloading of dishwasher contents. Upper and lower guide rails 124, 126 are mounted on tub side walls 128 and accommodate upper and lower roller-equipped rack assemblies 130, 132, respectively. Each of upper and lower racks 130, 132 is fabricated from known materials into lattice structures that include longitudinal rods 134 and crossing lateral rods (not visible in FIG. 1). Each rack assembly 130, 132 is adapted for movement between an extended loading position in which the rack is substantially positioned outside the wash chamber 106, and a retracted position (shown in FIG. 1) in which the rack is located inside wash chamber 106. Typically, a silverware basket (not shown) is removably attached to the lower rack 132 for placement of silverware, utensils, and the like that are too small to be accommodated by upper and lower racks 130, 132.

A control input selector 136 is mounted at a convenient location on an outer face 138 of the door 120 and is coupled to control circuitry and control mechanisms for operating a fluid circulation assembly to circulate water and dishwasher fluid in the dishwasher tub 104. The fluid circulation assembly is located in a machinery compartment 140 located below a bottom sump portion 142 of the tub 104.

A lower spray-arm-assembly 144 is rotatably mounted within a lower region 146 of the wash chamber 106 and above tub sump portion 142 so as to rotate in relatively close proximity to the lower rack assembly 132. A mid-level spray-arm assembly 148 is located in an upper region of the wash chamber 106 and is located in close proximity to the upper rack 130 and at a sufficient height above lower rack 132 to accommodate larger items, such as a dish or platter. In a further embodiment, an upper spray assembly may be located above the upper rack assembly 130 at a sufficient height to accommodate taller items in the upper rack assembly 130.

Figure 2:
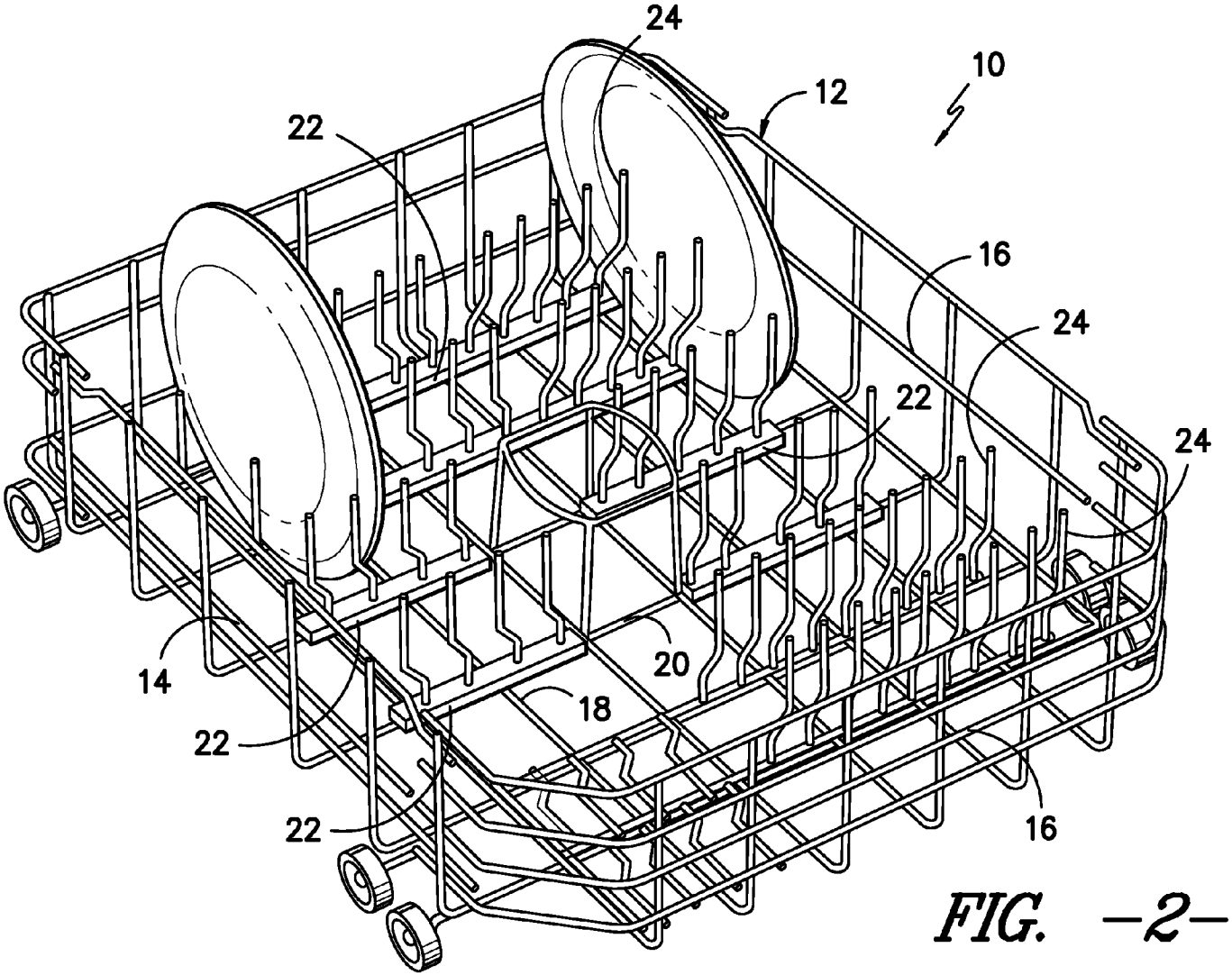
FIG. 2 is a perspective view of a rack assembly.

FIG. 2 is a perspective view of a rack assembly 10 in accordance with aspects of the invention. Although depicted as a bottom rack assembly particularly suited for dishes and plates, it should be appreciated that a rack assembly 10 in accordance with the invention may also be configured as an upper rack particularly suited for cups, bowls, and the like. The rack assembly 10 is not limited by its use in a dishwasher. The rack assembly 10 is generally configured as a basket-like structure 12 having a bottom wall 14 and surrounding side walls 16. The bottom wall 14 and side walls 16 may be formed with wire or rod members into an open lattice structure. For example, the bottom wall 14 may be defined by a plurality of longitudinal rods 18 that are crossed with a plurality of lateral rods 20, as generally known in the art. The rods 18, 20 may be connected together by any suitable means, including welding, clips, and so forth.

FIGS. 3 and 4 illustrate a particular embodiment of a dishwasher rack assembly 10 that includes at least one channel member 22 attached to one of the rods 20, 18 that define the open lattice structure of the bottom wall 14. In this particular embodiment, the channel members 22 are attached to the lateral rods 20 by any suitable mechanism. For example, the channel members 22 may include a groove or other engaging structure on the underside thereof that attaches directly onto the lateral rods 20. In a different embodiment, any manner of suitable clip may be utilized to attach the channel members 22 to the rods 20. It should be appreciated that the type of mechanism used to secure the channel members 22 to the individual rods 20, 18 is not a limiting feature of the invention.

A plurality of tines 24 are received within the channel member 22. The tines 24 are variably positionable along the channel member 22 so that the spacing (i.e. "pitch") between the tines 24 can be adjusting without adjusting the channel member 22 relative to the rod 20 on which it is attached.

The tines 24 may be infinitely positionable along the length of the channel member 22, for example along a top groove 26 that is defined in the channel member 22. In this embodiment, the groove 26 may include side walls that define a relatively tight friction fit with the tines 24 that holds the tines 24 in an upright orientation within the channel member 22. In different embodiments, as described in greater detail herein, the channel member 22 may define discrete vertically oriented tine locations 30 along the length thereof, with the respective tine locations 30 comprising an engagement profile defined in a side wall or top surface of the channel members 22 that engages and holds the tines in an upright orientation within the channel member 22.

The tines 24 may be provided in various configurations. In the embodiment of FIG. 3, a U-shaped tine member 32 includes a bridge 34 between opposite tines 24. The tines may include an offset leg 38 between a first vertical leg 36 and second vertical leg 40 that accommodates receipt and a desired orientation of the tines within the channel members 22.

In the embodiment of FIG. 4, a pair of the channel members 22 are provided spaced apart from each other on different ones of the lateral rods 20, for example adjacent lateral rods 20. A plurality of the tine members 32 are provided, with their respective bridges 34 extending between the channel members 22. The tines 24 extend upwardly from each bridge 34 and are received within the respective channel members 22.

In the embodiment of FIG. 4, the channel members 22 include a side groove 28 through which the bridge 34 extends, and the upright tines 24 extend through the top groove 26, which includes a plurality of discrete tine locations 30 defined therealong. The tines 24 are variably positionable as a pair along the channel members 22 by movement of the U-shaped tine member 32 relative to the channel members 22. For example, the tine member 32 may be moved along the length of the channel members 22 by disengaging the tine members 24 from one tine location 30 (as a pair) and moving the tine member 32 to a different pair of corresponding tine locations 30 in the channel members 22, wherein the tines 24 are engaged by the profile that defines the distinct tine location 30 within the channel members 22.

In an alternate embodiment that is similar to the embodiment depicted in FIGS. 3 and 4, the tine member 32 may be infinitely positionable along the length of the channel members 22, particularly along the top groove 26. In this embodiment, the discrete tine locations 30 are eliminated and the top groove 26 may be formed with relatively smooth side wall members that frictionally engage against the tines 24 to hold the tines in an upright orientation within the channel members 22.

FIGS. 5 and 6 depict another unique embodiment wherein a pair of the channel members 22 are spaced from each other on different ones of the rods, for example the lateral rods 20. In this embodiment, the tines 24 are individual members (i.e., not connected by a bridge member) and are individually positionable in respective ones of the channels members 22. In this manner, the tines in one channel member are variably positionable along a respective channel member 22 independent of the tines in the other channel member 22. The channel members 22 may have a plurality of discrete locations 30 along the length thereof, with the tines 24 including an insertion end 48 that is insertable into the tine locations 30. The tine locations 30 may be defined by individual respective holes 46, as depicted in FIG. 6. The tines 24 may have a stepped-profile insertion end 48 that includes a shoulder or offset portion 50 that engages against a bottom of the channel 26 to hold up tines 24 in an upright orientation within the channel members, as can be readily appreciated from the side cross-sectional view of FIG. 6.

Figure 7:
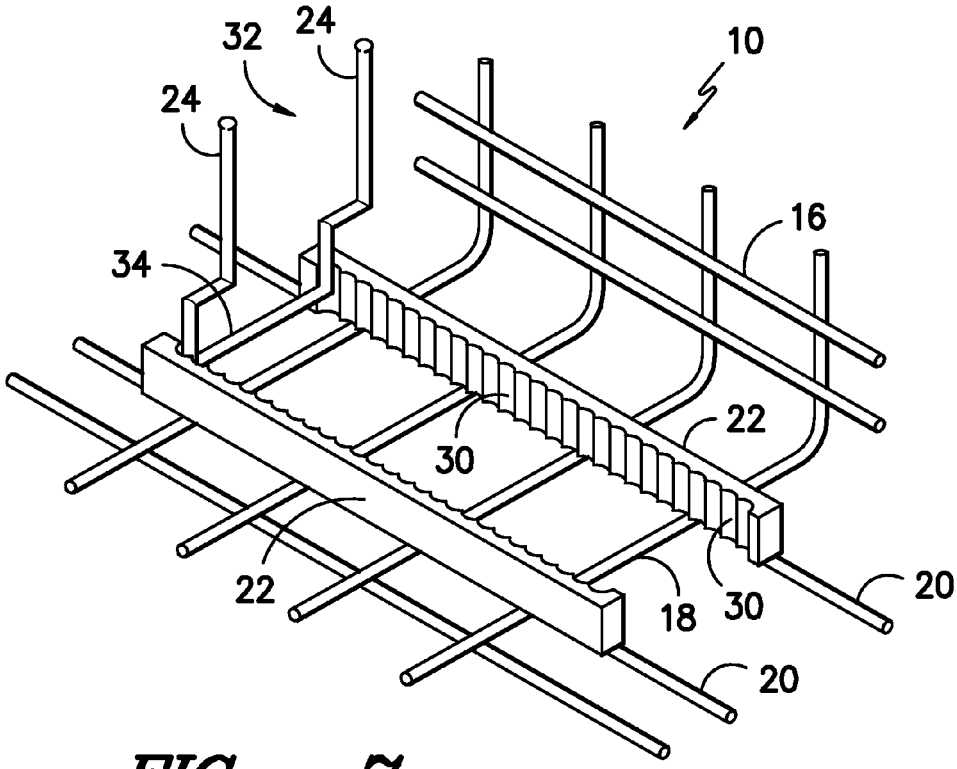
FIG. 7 is a perspective view of still another embodiment of channel members and U-shaped tine members.

FIG. 7 depicts an alternative embodiment of a rack assembly 10 that is similar to the embodiment of FIG. 4 except that the channel members 22 do not include a top groove or side groove. In this particular embodiment, the channel members 22 include vertically oriented tine positions 30 along an inside face thereof, with the tine locations 30 extending vertically along the entire face. The tine locations 30 include an engagement profile that is configured to engage a bottom vertical leg portion 36 of the tine members 32 (FIG. 3). The tine locations 30 may have, for example, a semi-circular cross-section that generally matches the diameter of the first leg portion 36 in a relatively tight friction fit. It should be readily appreciated that the tine location 30 may have any cross-sectional shape depending on the shape of the tine member 24, particularly the first leg sections 36. For example, the first leg section 36 may have a square or rectangular profile that engages in a square or rectangular shaped tine locations 30, and so forth. To position the tine member 32, the tines 24 are pressed toward each other in order to disengage the first vertical leg section 36 from their respective tine locations 30. The tine member 32 can then be advanced to any other pair of tine locations 30 and the tines 24 released so that the first vertical legs 36 engage into the new tine locations 30.

Figure 8:
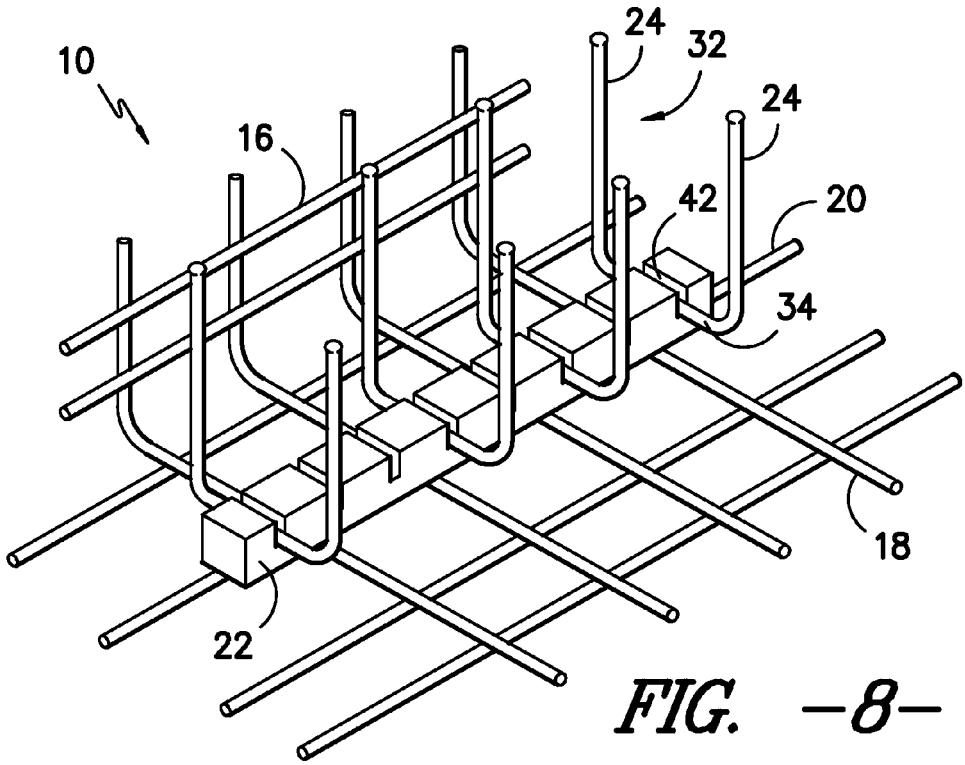
FIG. 8 is a perspective view of a single channel member embodiment engaged with U-shaped tine members.

In still a further embodiment of a rack assembly 10 depicted in FIGS. 8 through 10, the tine members 32 may be held in a single channel member 22 such that the tines 24 extend vertically upwards on opposite sides of the channel member 22. The channel member 22 may include a plurality of discrete horizontally oriented bridge locations 42 spaced apart along the length of the channel member 22, as particularly depicted in FIG. 8, the bridge portion 34 of the individual tine members 32 are insertable into and removable from the bridge locations 42 in order to change the spacing of the tines 24 as desired. The bridge locations 42 may define a relatively tight friction fit with the bridge portion 34 to keep the tines in an upright position. In alternative embodiments, any manner of inter-engaging structure between the two components may be utilized to maintain the tines in an upright position. A particularly unique feature of the embodiment indicated in FIGS. 8 through 10 is the ability to rotate the tine members 32 to a position indicated in FIG. 9, wherein the tines 24 lie essentially across the rod members defining the bottom wall 14 of the rack assembly 10. This embodiment may be useful wherein it is desired to place relative large items, such as serving bowls, in the rack assembly without interference from tines 24. The rotating feature of the tine members 32 may be accomplished in various ways. In the illustrated embodiment, the tine member 32 may include a multi-faceted engagement section 44 that fits into a correspondingly shaped bridge location 42. The multi-faced cross-sectional profile of the engagement section 44 and bridge location 42 will prevent inadvertent rotation of the tines 24, yet allow for forceable rotations of the tines when desired, so as long the channel member 22 is formed of a material having some degree of flexibility at the bridge locations 42. In an alternative embodiment, in order to move the tines 24 to the down position indicated in FIG. 9, the tine member 32 may be removed from the bridge location 42, and then reinserted into the bridge location 42 upon changing the orientation of the tines 24.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher rack assembly, comprising:

a bottom wall formed of a first set of spaced apart rods crossed by a second set of spaced apart rods to define an open lattice structure;

a pair of channel members spaced from each other and attached to different ones of said rods;

a plurality of U-shaped tine members having a bridge between opposite tines, said bridge extending between said channel members and said tines received within said channel member, wherein said tine members are variably positionable along said channel members by movement of said tine members relative to said channel members; and wherein said channel members comprise a top groove through which said tines project and a side groove that accommodates sliding movement of said bridge alone said channel members.

2. The dishwasher rack assembly as in claim 1, wherein said channel member defines a top groove, said tines being infinitely positionable along said top groove, said top groove defining a friction fit with said tines that holds said tines in an upright orientation within said channel members.

3. The dishwasher rack assembly as in claim 1, wherein said channel member defines vertically oriented discrete tine locations along the length thereof, said tine locations comprising an engagement profile that holds said tines in an upright orientation within said channel member.

4. The dishwasher rack assembly as in claim 1, wherein said top groove defines a plurality of discrete tine locations along the length thereof, said tine locations comprising an engagement profile that holds said tines in an upright orientation within said channel members.

5. The dishwasher rack assembly as in claim 1, wherein said tines are infinitely positionable to any location along said top groove, said top groove defining a friction fit with said tines that holds said tines in an upright orientation within said channel members.

6. The dishwasher rack assembly as in claim 1, wherein said pair of channel members define vertically oriented discrete tine locations along the length thereof, said tine locations comprising an engagement profile that holds said tines in an upright orientation within said channel members, said tines adjustable along said channel members upon flexing of said tines inwardly to disengage said tines from said tine locations.

7. The dishwasher rack assembly as in claim 1, wherein said pair of channel members comprise a plurality of discrete horizontally oriented bridge locations defined along the length thereof, said tine members movable into and out of said bridge locations.

8. The dishwasher rack assembly as in claim 7, wherein said bridge locations are defined in a top surface of said channel members and comprise a cross-sectional shape that engages a complimentary-shaped section of said bridge that holds said tines in an upright orientation within said channel members.

9. The dishwasher rack assembly as in claim 8, wherein said bridge is rotatable within said bridge locations such that said tines are rotatable to a down position wherein said tines lie across said rod members.

10. The dishwasher rack assembly as in claim 1, wherein said channel members comprise a plurality of discrete tine locations along the length thereof, said tines insertable into said tine locations.

11. The dishwasher rack assembly as in claim 10, wherein said tines comprise a stepped-profile insertion end that is insertable into vertically oriented receipt holes at said respective tine locations to hold said tines in an upright orientation within said channel members.

12. The dishwasher rack assembly as in claim 1, wherein said rack assembly is a bottom rack assembly for a dishwasher.

* * * * *